US007850272B2

(12) United States Patent
Sato

(10) Patent No.: US 7,850,272 B2
(45) Date of Patent: Dec. 14, 2010

(54) RECORDING APPARATUS

(75) Inventor: Takashi Sato, Edogawa-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/549,226

(22) Filed: Aug. 27, 2009

(65) Prior Publication Data

US 2009/0309914 A1 Dec. 17, 2009

Related U.S. Application Data

(62) Division of application No. 11/686,117, filed on Mar. 14, 2007, now Pat. No. 7,600,841.

(30) Foreign Application Priority Data

Mar. 15, 2006 (JP) ..... 2006-071128

(51) Int. Cl.
*B41J 29/38* (2006.01)

(52) U.S. Cl. ..... 347/14; 347/5; 347/43

(58) Field of Classification Search ..... 347/5, 347/9, 14, 19, 42, 43
See application file for complete search history.

(56) References Cited

U.S. PATENT DOCUMENTS 6,652,057 B2 * 11/2003 Masuda et al. ..... 347/14
6,880,904 B2 * 4/2005 Masuda ..... 347/5
2002/0186276 A1 * 12/2002 Nakagawa ..... 347/43

* cited by examiner

*Primary Examiner*—Lam S Nguyen
(74) *Attorney, Agent, or Firm*—Canon U.S.A., Inc., IP Division

(57) ABSTRACT

A recording apparatus for performing recording by scanning a recording head includes an acquisition unit configured to acquire temperature information of the recording head, a generation unit configured to generate a signal that indicates outputting of an output voltage based on the temperature information, a voltage control unit configured to control a voltage to be output to the recording head based on the signal, and a control unit configured to simultaneously perform preliminary ejection processing in an interval between a previous scan and a next scan of the recording head and output processing of the signal.

2 Claims, 12 Drawing Sheets

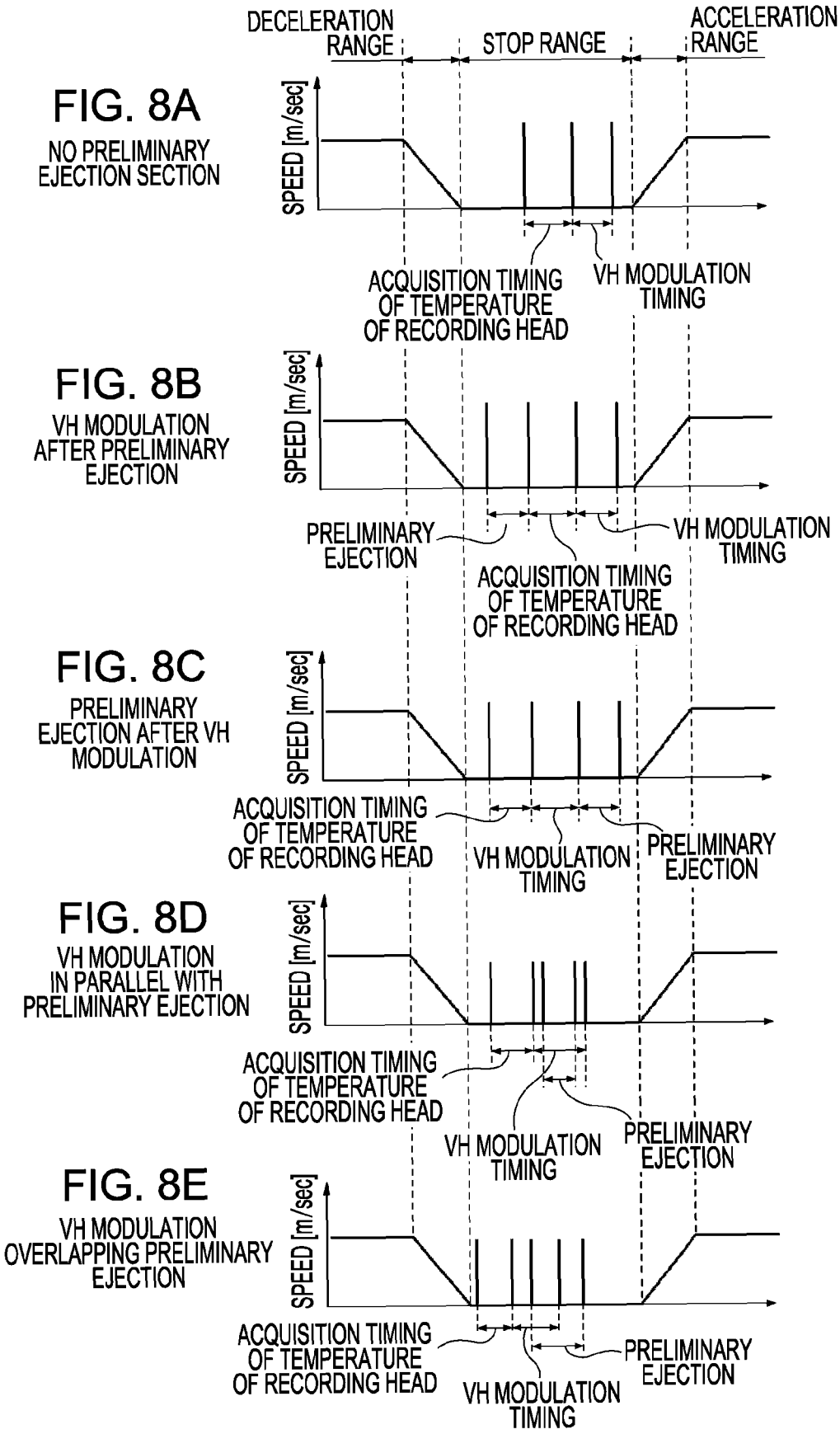
DECELERATION RANGE
STOP RANGE
ACCELERATION RANGE
FIG. 8A
NO PRELIMINARY EJECTION SECTION
SPEED [m/sec]
ACQUISITION TIMING OF TEMPERATURE OF RECORDING HEAD
VH MODULATION TIMING
FIG. 8B
VH MODULATION AFTER PRELIMINARY EJECTION
SPEED [m/sec]
PRELIMINARY EJECTION
VH MODULATION TIMING
ACQUISITION TIMING OF TEMPERATURE OF RECORDING HEAD
FIG. 8C
PRELIMINARY EJECTION AFTER VH MODULATION
SPEED [m/sec]
ACQUISITION TIMING OF TEMPERATURE OF RECORDING HEAD
VH MODULATION TIMING
PRELIMINARY EJECTION
FIG. 8D
VH MODULATION IN PARALLEL WITH PRELIMINARY EJECTION
SPEED [m/sec]
ACQUISITION TIMING OF TEMPERATURE OF RECORDING HEAD
VH MODULATION TIMING
PRELIMINARY EJECTION
FIG. 8E
VH MODULATION OVERLAPPING PRELIMINARY EJECTION
SPEED [m/sec]
ACQUISITION TIMING OF TEMPERATURE OF RECORDING HEAD
VH MODULATION TIMING
PRELIMINARY EJECTION

RECORDING APPARATUS

CROSS REFERENCE TO RELATED APPLICATIONS

This application is a Divisional of U.S. patent application Ser. No. 11/686,117 filed Mar. 14, 2007, issued U.S. Pat. No. 7,600,841, which claims priority from Japanese Patent Application No. 2006-071128 filed Mar. 15, 2006, the entire contents of both of which are hereby incorporated by reference.

BACKGROUND OF THE INVENTION

1. Field of the Invention

The present invention relates to a recording apparatus for recording an image on a recording medium.

2. Description of the Related Art

A thermal printer and an inkjet recording apparatus, which records characters and images by ejecting ink onto a recording medium, such as recording paper, are well known as a recording apparatus. An inkjet recording apparatus, which is typically used as an information outputting unit of a printer, a copier, or a facsimile machine, performs recording by ejecting ink while moving a relative position between a recording medium and an inkjet recording head. The image quality of a recording result of the inkjet recording apparatus depends on control of a relative velocity between the inkjet recording head and the recording medium, control of an ejection timing associated therewith, and stability of power supply to the recording head.

Ink jet recording apparatuses are broadly divided into a so-called serial type and full-line type. The serial-type recording apparatus performs recording by ejecting ink while moving an inkjet recording head and is commonly and widely used.

The ink ejecting recording head can eject ink by the operation of a piezoelectric element, the momentary surface boiling of ink, or some other operation. A recording head that ejects ink by boiling of ink supplies ejection energy by boiling ink adjacent to a heater in the vicinity of an ink path adjacent to an ink nozzle by energization of the heater.

In order to maintain satisfactory image quality, it is important to generate uniform ink droplets by continuous stable supply of energy required for ejecting ink and by maintaining the same conditions for ink ejection. However, in recording operations, a duty ratio varies with image data, and thus the number of heaters simultaneously energized varies. Therefore, driving conditions vary depending on effects of voltage variations caused by the difference between output currents of a power source, the difference between drop voltages caused by the resistive component in a transmission system, and some other factor.

Ink ejection control described above is carried out in a range that satisfies a stable ejection condition by use of high accuracy of an output voltage of a power source or a transmission system that has a structure with lower loss. A DC/DC converter that supplies the recording head with power is described below.

FIG. 10 illustrates a block diagram of a voltage control system including a DC/DC converter in the related art. A DC/DC-converter input voltage Vin supplied from a power-source unit (not shown) is input to a switching element 201. The input voltage Vin is output from the switching element 201 and a diode 209 as a direct-current output converted via an inductor 202 and a capacitor 204. The output is supplied as an output voltage VH to a recording head being a load. The switching element 201 is connected to a capacitor 203 at its input side and to the capacitor 204 at its output side via the inductor 202. The inductor 202 and the capacitor 204 constitute a smoothing circuit 205. The output voltage signal VH detected from an output terminal of the smoothing circuit 205 is subjected to direct-current voltage division by a resistor R1 and a resistor R3 in a voltage control circuit 206, is input to an error amplifier 207 included in the voltage control circuit 206, and is feedback-controlled.

An output signal from the error amplifier 207, which receives a Vcc potential from a reference voltage 212 and a feedback output voltage signal VH, is an output signal of the voltage control circuit 206 and performs pulse-width modulation (PWM) control and constant voltage control on the switching element 201 via a PWM comparator circuit 208. A resistor R5 and a capacitor C1 connected to an inversion terminal and an output terminal of the error amplifier 207, respectively, constitutes an example of a phase compensation circuit for adjusting stability and responsivity of an output voltage.

As described above, power is supplied such that feedback is controlled so that a stable output voltage is supplied so as to accommodate variations in output current caused by variations in the number of nozzles simultaneously driven on a recording head being a load.

The recent improvement in semiconductor processes enables the switching speed of a DC/DC converter to be driven at the megahertz level. Additionally, the responsivity of feedback control found in current-mode control is becoming high, like the advent of a control IC that achieves high responsivity on the order of microseconds, so it becomes possible to accurately supply power.

For an inkjet recording head, the performance of ink ejection is apt to depend on the temperature of the recording head. In particular, in a thermal inkjet recording apparatus, since ink droplets are ejected from nozzles by film boiling of ink caused by energization of heater resistors of the recording head, the temperature of the recording head during printing varies constantly.

In particular, when a larger number of sheets are printed continuously or a high-duty image is printed, the frequency of foaming of ink in the recording head increases and the number of ink ejection operations is high, and thus the temperature of the recording head gradually rises.

For the performance of ink ejection with respect to temperature, at low temperatures, the viscosity of ink is high and thus it is difficult to eject, and at high temperatures, the viscosity of ink is low and thus the amount of ink ejected from nozzles increases. Therefore, a defect of ink ejection, such as an increased diameter of a dot of a pixel formed on a recording medium, occurs.

Japanese Patent Laid-Open No. 10-119273 describes correction of energy for heat generation with respect to variations in the temperature of a recording head by controlling a driving pulse width.

However, if the temperature of the recording head itself continues rising by continuous recording operations, control of only the driving pulse width may not suppress an increase in the amount of ink ejection. That is, under present circumstances, it is difficult to perform control of reducing the amount of ink ejection by only pulse-width control.

SUMMARY OF THE INVENTION

The present invention provides a recording apparatus capable of recording a high-quality image through stabilization of the amount of ink ejection effected by modulation of not only a driving pulse but also a driving voltage in consideration of the temperature of a recording head.

An aspect of the present invention provides a recording apparatus for performing recording by scanning a recording head. The recording apparatus includes an acquisition unit configured to acquire temperature information of the recording head, a generation unit configured to generate a signal that indicates outputting of an output voltage based on the temperature information, a voltage control unit configured to control a voltage to be output to the recording head based on the signal, and a control unit configured to simultaneously perform preliminary ejection processing in an interval between a previous scan and a next scan of the recording head and output processing of the signal.

Further features of the present invention will become apparent from the following description of exemplary embodiments (with reference to the attached drawings).

BRIEF DESCRIPTION OF THE DRAWINGS

FIGS. 8A to 8E are illustrations for describing a timing of modulation of an output voltage of the DC/DC converter according to the exemplary embodiment.

DESCRIPTION OF THE EMBODIMENTS

Exemplary embodiments of the present invention are described below with reference to the drawings. In the exemplary embodiments described below, an inkjet recording apparatus is described by way of example.

Figure 9:
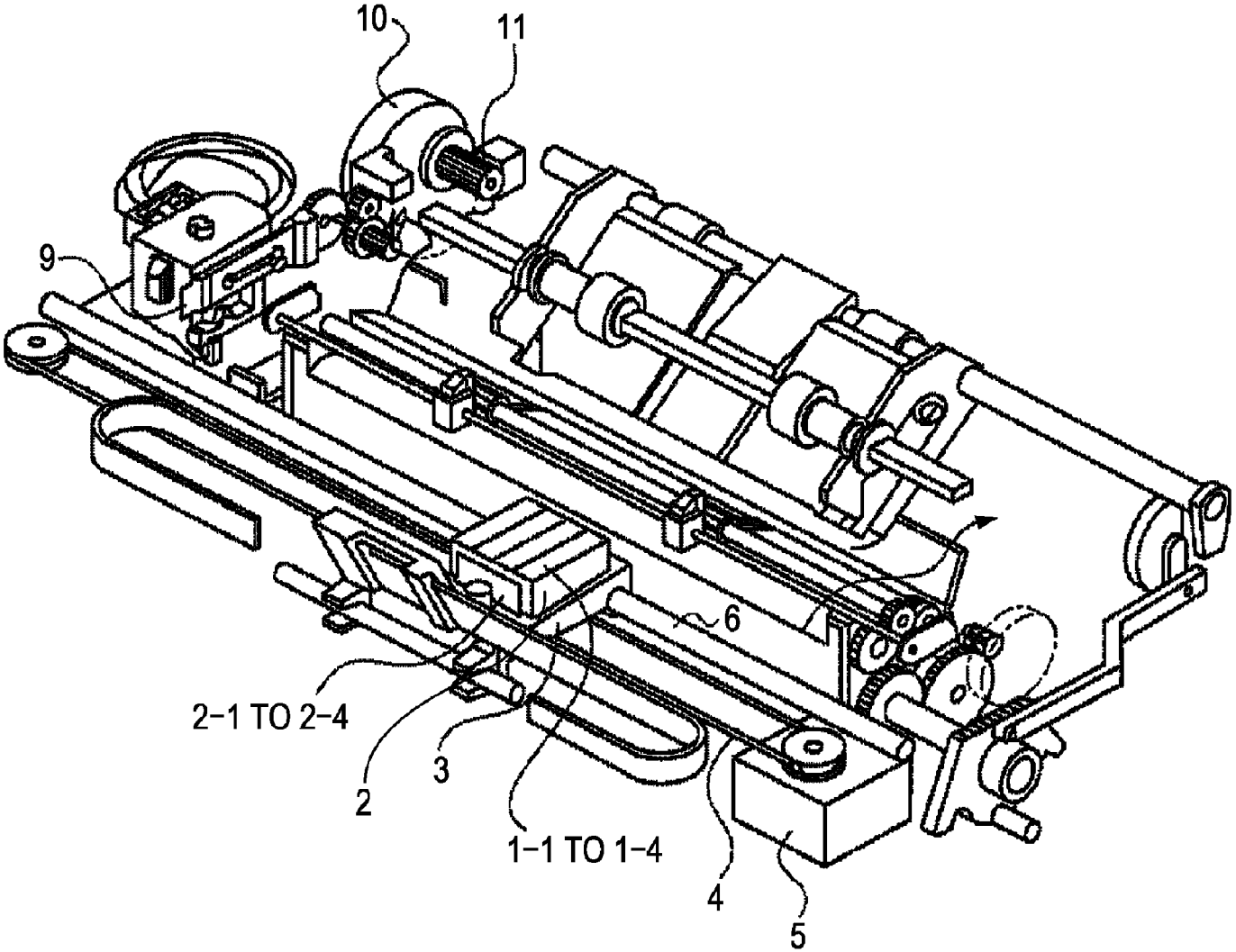
FIG. 9 is a perspective view of the recording apparatus according to the exemplary embodiment.
Figure 10:
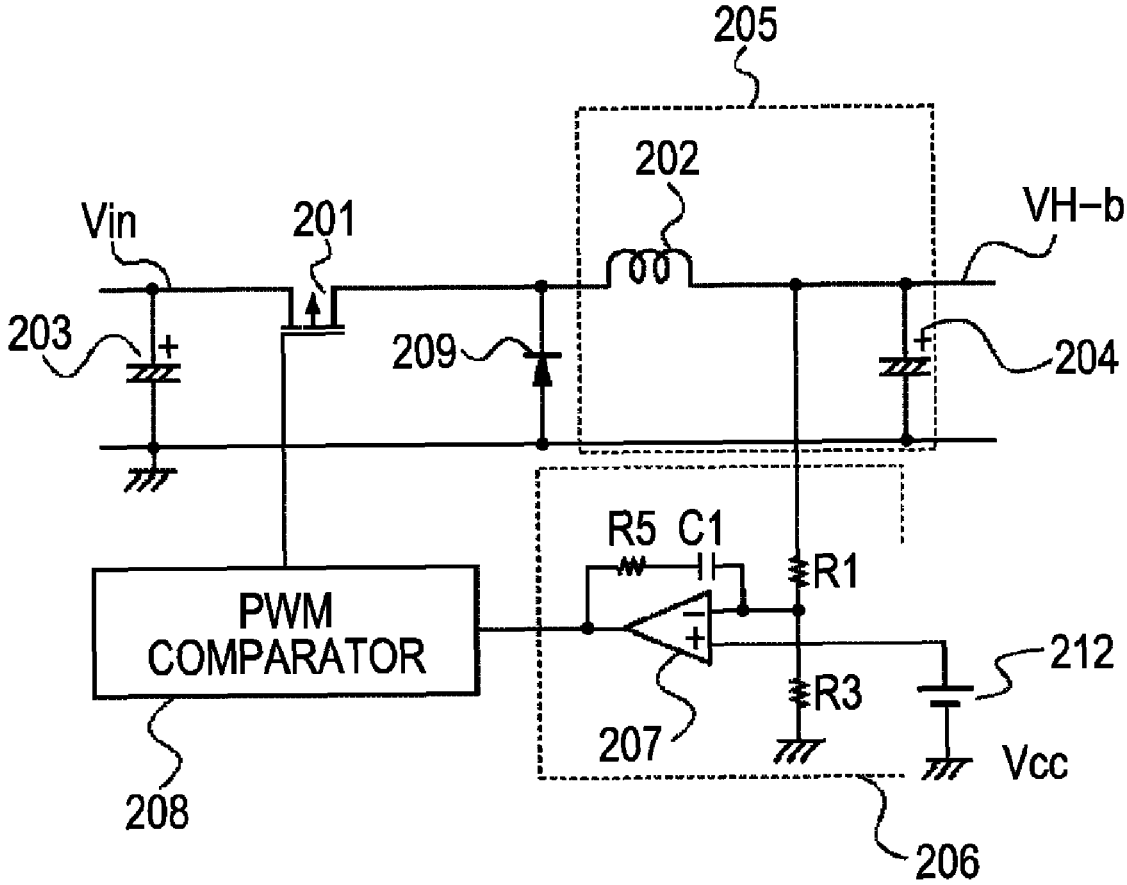
FIG. 10 RELATED ART
FIG. 10 is a diagram of a known DC/DC converter.

As illustrated in FIG. 9, the recording apparatus according to an exemplary embodiment performs recording on a recording sheet by using a recording head 2 composed of a black (Bk) head unit 2-1, a yellow (Y) head unit 2-2, a magenta (M) head unit 2-3, and a cyan (C) head unit 2-4. These four head units and a DC/DC converter 50 (not shown in FIG. 1) are mounted on a carriage 3.

The carriage 3 is attached to part of a driving belt 4 for transmitting a driving force of a carriage drive motor 5 and moves along a guide shaft 6. This structure enables the recording head 2 to perform scan recording on a recording sheet and to form an image on the recording sheet.

By use of a signal of a carriage encoder 403 (not shown) arranged in parallel with the guide shaft 6, moving and stopping of the recording head 2 and a recording position are controlled.

The inkjet recording head units 2-1 to 2-4 each include a plurality of head nozzles for ejecting ink at an ejection surface facing a recording surface of the recording sheet. The nozzles have the form of a thin pipe and are arranged in parallel. The inkjet recording head units 2-1 to 2-4 each further include a heater in the proximity of the nozzles. The heater provides ejection energy to ink supplied from integral ink tanks 1-1 to 1-4.

The nozzles of the inkjet recording head units 2-1 to 2-4 are aligned so as to be substantially perpendicular to the direction of scanning of the carriage 3. The four recording head units 2-1 to 2-4 are arranged along the direction of scanning of the carriage 3.

The inkjet recording apparatus described above converts data into recording data corresponding to the recording head 2 on the basis of data such as an image information control command input from an external host device and the like. The recording data is transferred to the recording head 2 while the carriage 3 performs scanning, and the recording head 2 ejects ink at a necessary timing, so that an image is formed on the recording sheet.

The carriage 3 is connected to a main substrate with a flexible cable 11 and receives various signals and power necessary for the sensor and the DC/DC converter 50.

Figure 1:
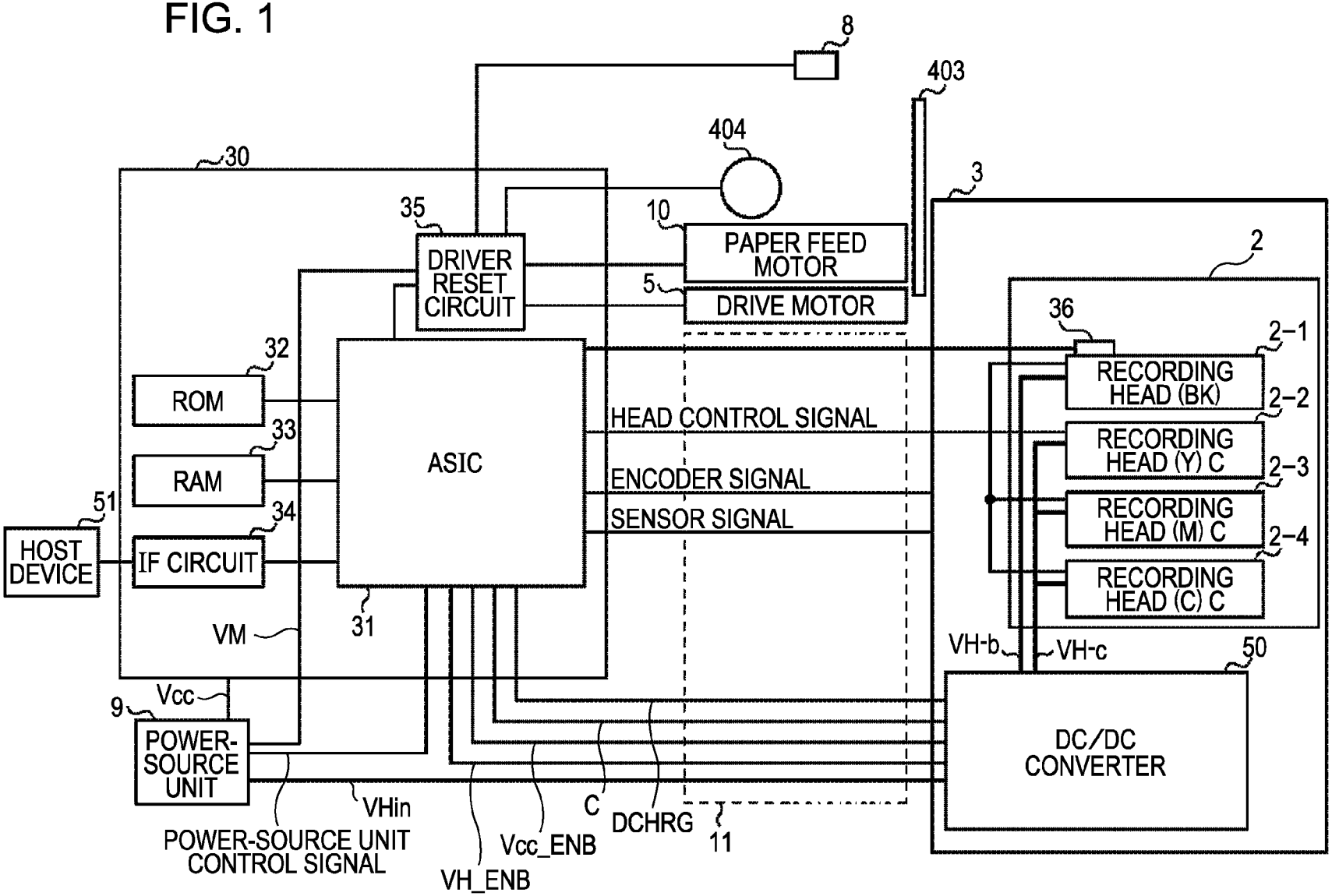
FIG. 1 is a block diagram of a recording apparatus according to an exemplary embodiment of the present invention.

FIG. 1 is a block diagram illustrating a first exemplary embodiment. A main substrate 30 includes an application-specific integrated circuit (ASIC) 31, a read-only memory (ROM) 32, a random-access memory (RAM) 33, both of which function as a storing unit, an interface circuit 34, and a driver reset circuit 35. The interface circuit 34 receives data and a command from a host device 51. The driver reset circuit 35 drives the drive motor 5 and a paper feed motor 10. The ASIC 31 includes a central processing unit (CPU) and a plurality of control blocks (not shown). Examples of the control blocks include an ejection control unit for the recording head 2, a drive control unit for the motors, and a control unit for controlling a power source.

The drive motor 5 can be, for example, a stepping motor or a DC motor. The ASIC 31 transmits a signal for the drive motor 5 to the driver reset circuit 35 to move the carriage 3 and at the same time keeps track of the present position of the carriage 3, which mounts the recording head 2, by managing the number of operation signals from a datum point in the direction of scanning and a signal from the carriage encoder 403.

When the carriage 3 moves and reaches a position at which the mounted recording head units 2-1 to 2-4 are to eject ink, the ASIC 31 controls the recording head units 2-1 to 2-4 to eject ink.

Although only management of a driving pulse of the drive motor 5 would allow a print position in the direction of scanning to be detected, the recording apparatus according to the present embodiment includes the dedicated carriage encoder 403 to detect the position of the carriage 3 more accurately and uses a signal from the carriage encoder 403 to detect the position of the carriage.

The ASIC 31 controls operation of the inkjet recording apparatus in accordance with a program previously stored in the ROM 32 or a control command input from the host device 51 via the interface circuit 34. The ROM 32 holds a program used for causing the ASIC 31 to operate and various table data required for control of the recording head 2.

The interface circuit 34 functions as an interface used when a control command and control data are exchanged between the host device 51 and the inkjet recording apparatus.

The RAM 33 contains a work area used during computation of the ASIC 31 or a temporary storage area for recording data and control code input from the host device 51 via the interface circuit 34. A print buffer, which stores bit data corresponding to nozzles of the recording head 2 developed from the recording data, is present in the RAM 33.

A power-source unit 9 supplies a Vcc voltage to the main substrate 30, supplies a VM voltage to the driver reset circuit 35, the paper feed motor 10, and the drive motor 5, and supplies a VHin voltage to a DC/DC converter 50.

The DC/DC converter 50 performs control of changing the value of the VH voltage to be supplied to the recording head 2 according to a DCHRG signal and a voltage setting signal C from the ASIC 31. The reference voltage Vcc for the DC/DC converter 50 is turned on or off by use of a Vcc_ENB signal. The VH modulation DC/DC converter 50 is turned on or off by use of a VH_ENB signal.

A temperature detecting unit 36 is adjacent to the nozzle heater of each of the inkjet recording head units 2-1 to 2-4 and detects the temperature of the nozzle heater of each of the inkjet recording head units 2-1 to 2-4. The temperature detecting unit 36 detects the temperature of the recording head 2. The temperature of the recording head 2 is transmitted to the ASIC 31 via an A/D converter (not shown) after being converted from an analog value to a digital value by the A/D converter.

A rise in the temperature of the recording head 2 increases the temperature of ink present in an ink channel inside the recording head prior to foaming and ejected. As a result, the temperature difference ΔT between the ejection temperature of ink in the recording head 2 and the temperature of film boiling of ink varies depending on the temperature of the recording head 2. Thus, if the temperature of ink prior to foaming varies, ink foaming energy required for ink ejection varies. Therefore, energy adjustment is necessary for stable ink ejection.

The ink foaming energy is adjusted by changing the value of an output voltage of the DC/DC converter 50 by ΔV to optimally adjust energy for ink foaming caused by the temperature difference ΔT. Additionally, in order to perform accurate and stable foaming, the value of the output voltage of the DC/DC converter 50 is corrected so as to be changed by change of the amount of ejection to the amount of electric power with respect to a change in the temperature of the recording head 2.

Figure 2:
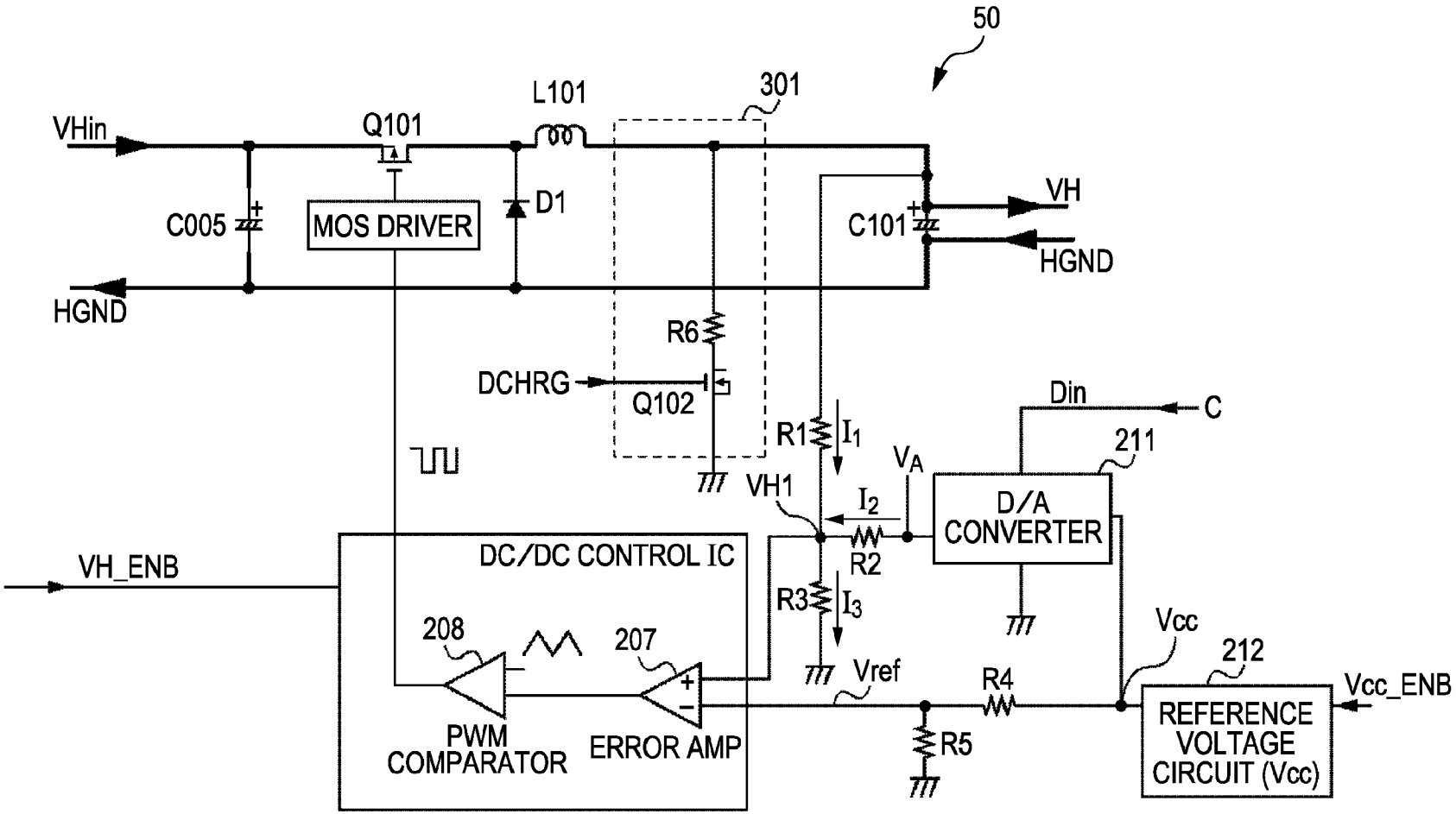
FIG. 2 is a diagram of a DC/DC converter according to the exemplary embodiment.

The actual DC/DC converter 50 is described below with reference to FIGS. 2 and 3. FIG. 2 is a circuit diagram for describing an example of the structure of the DC/DC converter 50. In the present embodiment, a DC/DC-converter input voltage Vin supplied from a power-source unit (not shown) is input to a switching element Q101. The switching element Q101 is connected to a capacitor C005 at its input side and to the capacitor C101 at its output side via the inductor L101.

The Vcc_ENB signal is a signal that turns on or off a reference-voltage circuit 212. The reference-voltage circuit 212 is operated by the Vcc_ENB signal having an H level and supplies a reference voltage for a DC/DC control circuit (DC/DC control IC) via a D/A converter 211 and resistors R4 and R5. The Vcc_ENB signal having an L level turns off the reference-voltage circuit 212.

The VH_ENB signal is supplied to the DC/DC control IC and turns on or off the operation of the DC/DC converter 50. The VH_ENB signal having an H level turns on the DC/DC converter 50. The VH_ENB signal having an L level turns off the DC/DC converter 50.

To modulate an output voltage VH, the DC/DC converter 50 according to the present embodiment adds a current to a division point of the output voltage VH by the D/A converter 211. The reference-voltage circuit 212 outputs a Vcc potential to the D/A converter 211 when the Vcc_ENB signal output from the ASIC 31 is at the H level. At this time, the Vcc potential is also supplied to an error amplifier 207 of the DC/DC control IC via the resistors R4 and R5.

The D/A converter 211 receives a reference voltage Vcc generated by the reference-voltage circuit 212 and outputs an output voltage $V_A$ corresponding to a control signal (digital signal) C output from the ASIC 31.

Therefore, a current $I_2$ corresponding to the output voltage $V_A$ is added to a division point of resistors R1 and R3 via a resistor R2. For example, if the control signal C is an 8-bit digital signal, the output of the D/A converter 211 can be adjusted in 256 levels. In this case, the output voltage $V_A$ of the D/A converter 211 is represented by the following expression:

$$VA = \frac{Vcc}{2^8} \times Xbit$$

where Vcc denotes an input voltage of the D/A converter 211 and Xbit denotes a value of the 8-bit control signal C. By addition of the current $I_2$ corresponding to the output voltage $V_A$ to the division point of the resistors R1 and R3, the output voltage VH is changed in the following manner.

A voltage VH1 to be input to a noninverting terminal of the error amplifier 207 is controlled so as to eliminate the error between the voltage VH1 and a reference voltage Vref to be input to an inverting terminal of the error amplifier 207. Therefore, currents $I_1$, $I_2$, and $I_3$ passing through the resistors R1, R2, and R3, respectively, are represented by the following expressions:

$$I_1 = \frac{VH - Vref}{R1}$$

$$I_2 = \frac{VA - Vref}{R2}$$

$$I_3 = \frac{Vref}{R3}$$

By applying Kirchhoff's current law:

$$I_1 + I_2 = I_3$$

$$\frac{VH1 - Vref}{R1} + \frac{VA - Vref}{R2} = \frac{Vref}{R3}$$

Hence, the output voltage VH is represented by the following expressions:

$$VH - Vref = R1\left\{\frac{Vref}{R3} - \frac{(VA - Vref)}{R2}\right\}$$

$$VH = Vref + R1\left\{\frac{Vref}{R3} + \frac{Vref - VA}{R2}\right\}$$

In this way, the output voltage VH can be changed by changing the value of the output voltage $V_A$ of the D/A converter 211.

A discharge circuit 301 includes a MOS-FET Q102, which functions as a switching element, and a resistor R6 for restricting a discharge current. The discharge circuit 301 removes a charge from a capacitor C101 when the DC/DC converter 50 is turned off. The discharge circuit 301 removes a charge from the capacitor C101 when the output voltage VH is modulated.

A DCHRG signal is a signal that turns on or off the discharge circuit 301 of the DC/DC converter 50 and is supplied to a gate of the switching element Q102. When the DCHRG signal is at an H level, the switching element Q102 is turned on. When the DCHRG signal is at an L level, the switching element Q102 is turned off.

Figure 3:
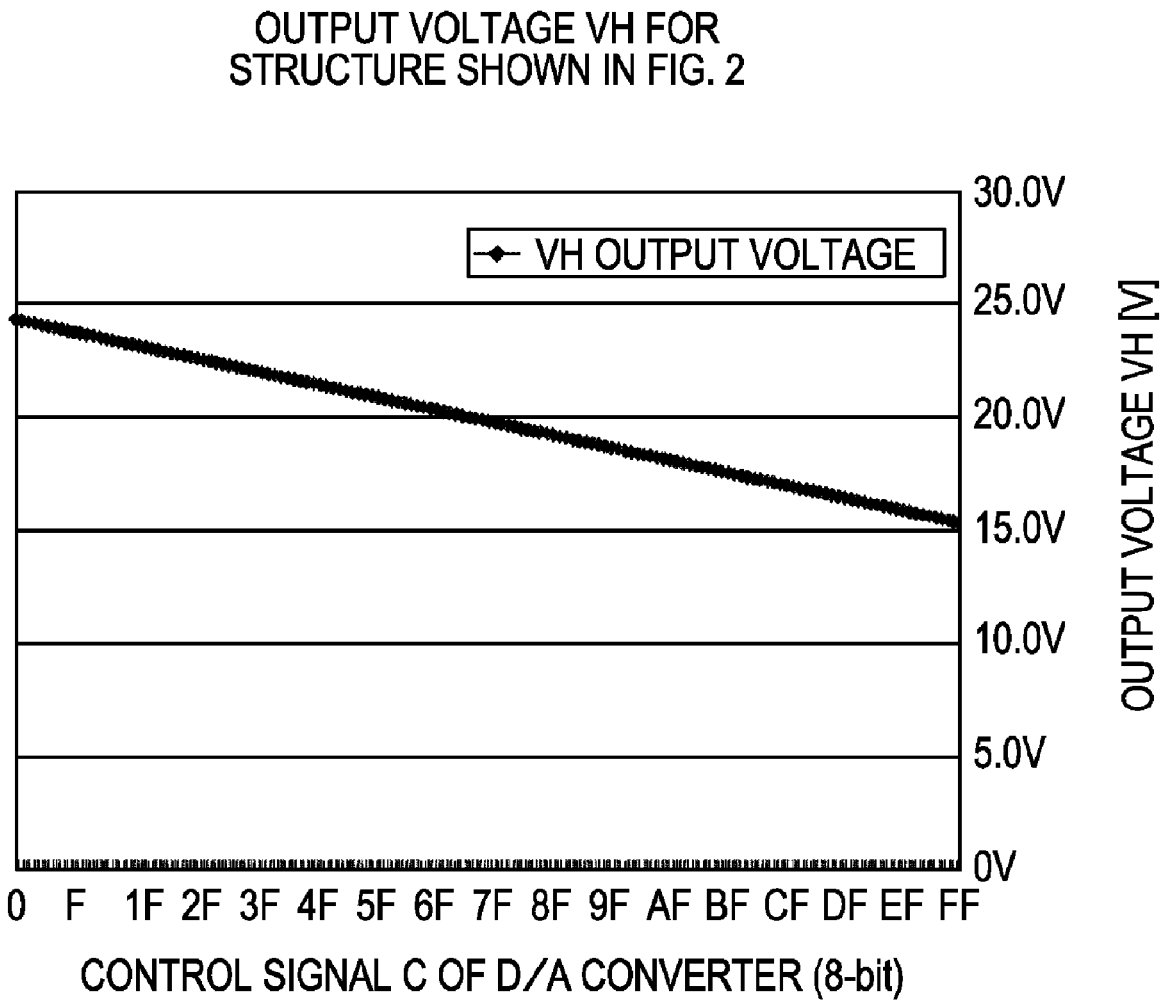
FIG. 3 is a graph of an output voltage of the DC/DC converter according to the exemplary embodiment.

FIG. 3 shows a relationship between a selected value of an 8-bit control signal C and an output voltage VH. In the present embodiment, as the value of the control signal C increases, the output voltage $V_A$ of the D/A converter 211 increases and a current $I_2$ after passing through the resistor R2 increases. Since the relationship among current values is $I_1+I_2=I_3$, an increase in current $I_2$ reduces a current $I_1$ after passing through the resistor R1. A reduction in current $I_1$ reduces the output voltage VH. That is, feedback control in this circuit structure is that an increase in current $I_2$ after passing through the resistor R2 reduces the output voltage VH.

A timing of acquisition of temperature data and a timing of changing the voltage during printer operation are described with reference to FIGS. 4 and 5.

Figure 4:
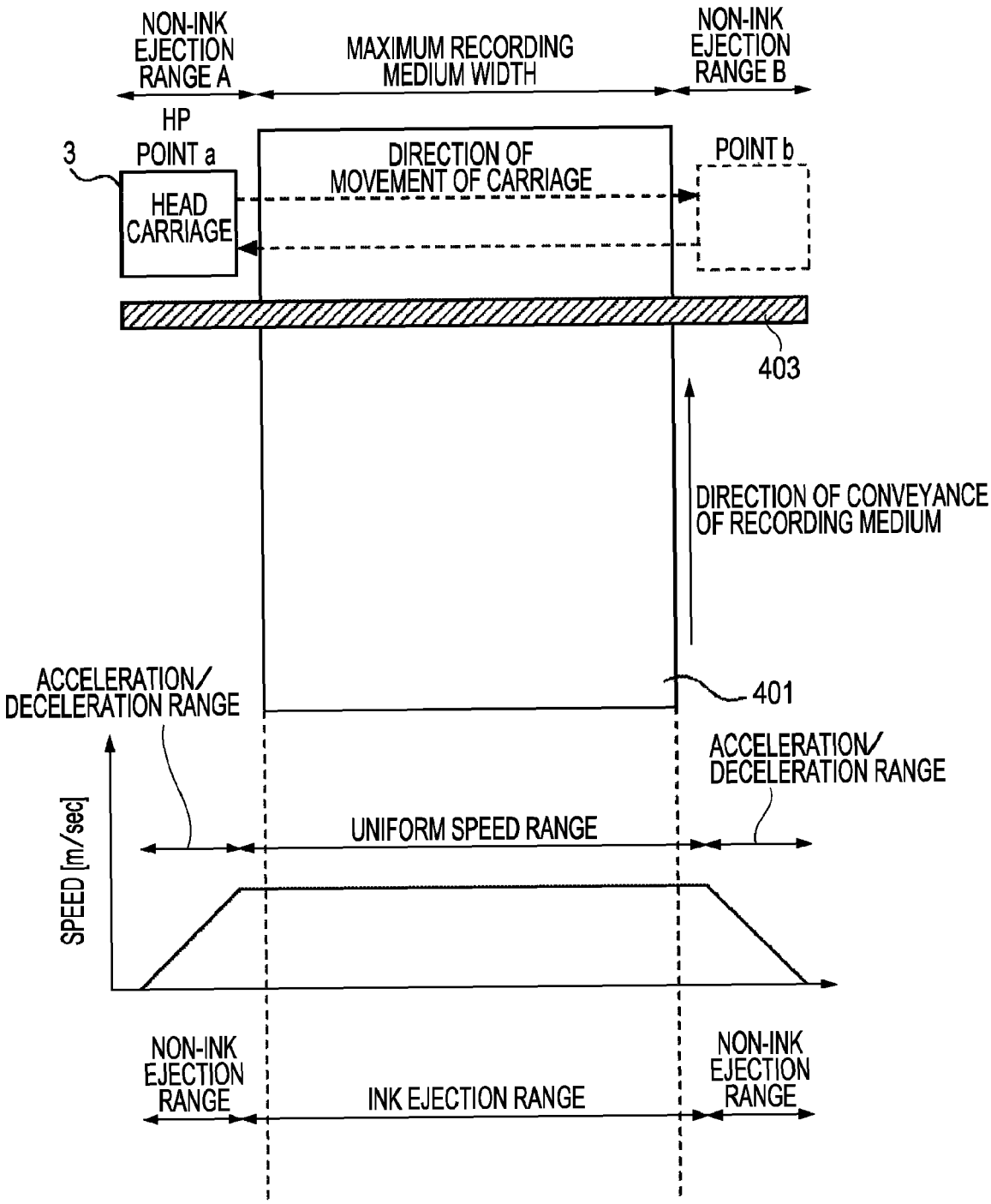
FIG. 4 is a schematic diagram for describing a timing of temperature detection and a timing of modulation of an output voltage of the DC/DC converter according to the exemplary embodiment.

FIG. 4 illustrates an operation of the carriage 3 with respect to a recording medium and is a schematic diagram of a timing of detection of temperature data of the recording head 2.

Figure 5:
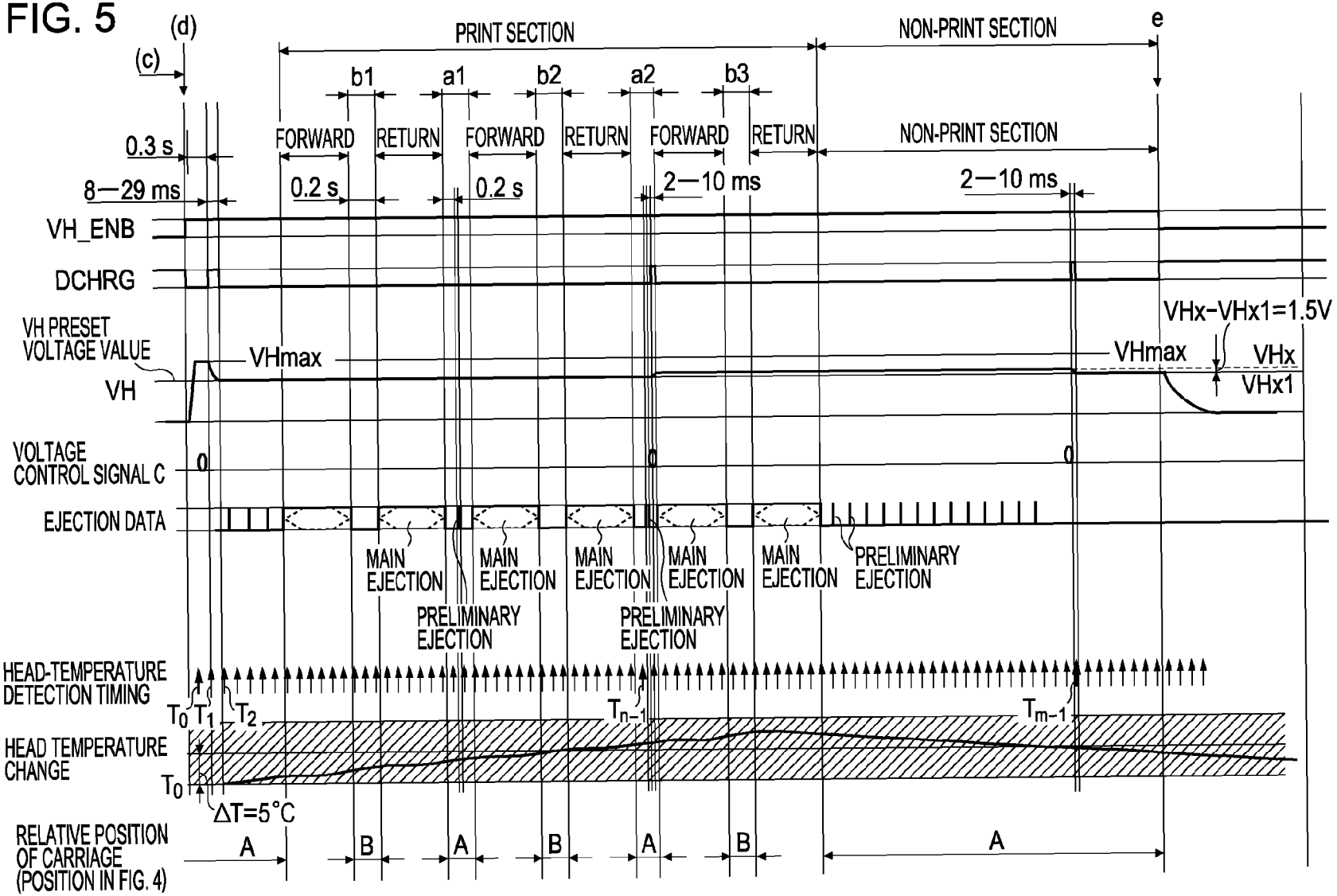
FIG. 5 is a sequence diagram for describing a timing of temperature detection and a timing of modulation of an output voltage of the DC/DC converter according to the exemplary embodiment.

FIG. 5 schematically illustrates a series of printer operations and illustrates a sequence of signals during the operations.

Each of a period (timing) A and a period (timing) B illustrated in FIG. 4 is a period during which ink is not being ejected. The period A and the period B illustrated in FIG. 4 correspond to a period A and a period B illustrated in FIG. 5, respectively.

Although a rise in the temperature of the recording head 2 increases the amount of ink ejection, the increase in the amount of ink ejection can be suppressed by increasing a driving voltage and shortening a pulse width. Therefore, the amount of ink ejection can be stabilized by increasing the VH voltage of the DC/DC converter 50 when the temperature of the recording head 2 rises and by reducing the VH voltage of the DC/DC converter 50 when the temperature of the recording head 2 declines.

Control of a pulse width is a known technique, so the description thereof is omitted. Modulation of a driving voltage of the recording head 2 is described below.

In FIGS. 4 and 5, the carriage 3 performs reciprocating motion, in which moving (scanning) from a point "a", which is also a home position of the carriage 3, to a point "b" with respect to a recording medium 401 and moving (scanning) from the point b to the point a, with respect to the recording medium 401. The carriage 3 forms an image on the recording medium 401 while performing the reciprocating motion in conjunction with conveyance of the recording medium 401.

The carriage 3 ejects ink to an end of a maximum recording-medium width of the apparatus to form an image. Therefore, the carriage 3 moves from a range A to a range B illustrated in FIG. 4. Each of the ranges A and B is an acceleration/deceleration range for turning the reciprocating motion of the carriage 3 to the opposite direction and a stop range. In the ranges A and B, the recording head 2 on the carriage 3 does not eject ink onto the recording medium 401.

When the carriage 3 moves directly above the recording medium 401, the carriage 3 is in a uniform speed range, in which an image is formed by ejection of ink and control of a relative speed between the carriage 3 and the recording medium 401 by conveyance of the recording medium 401.

In FIG. 4, since the recording head 2 performs ejection of ink a plurality of times while the carriage 3 moves from the point a (its home position) to the point b, the temperature of the recording head 2 gradually rises. The temperature of the recording head 2 when the carriage 3 has moved from the point a (its home position) to the point b, the temperature of the recording head 2 at the points a and b (or the points b and a) after the reciprocating motion is repeated a plurality of times, and the temperature of the recording head 2 when the carriage 3 returns to the point a (its home position) after an image is formed on a single recording medium increase substantially proportional to a print time, i.e., different from the temperature of the recording head 2 at the start of printing.

The increase in the temperature of the recording head 2 is not very sharp, but, if a high-duty image, which requires an increased number of ink ejection from the recording head 2, is formed or if an image is repeatedly formed on a plurality of recording media, the temperature of the recording head 2 gradually rises. In this case, image quality may be different for every recording medium or may be different according to the location where ink is ejected on a recording medium, so it is difficult to provide stable image quality.

A sequence of a series of recording operations and signals are described below with reference to FIG. 5. FIG. 5 illustrates that the power is turned on, recording is performed, and the status shifts to a standby mode. In FIG. 5, time progresses from left to right. Between a scan in the forward direction and a scan in the return direction, a recording sheet (recording medium) is conveyed.

Figure 11:
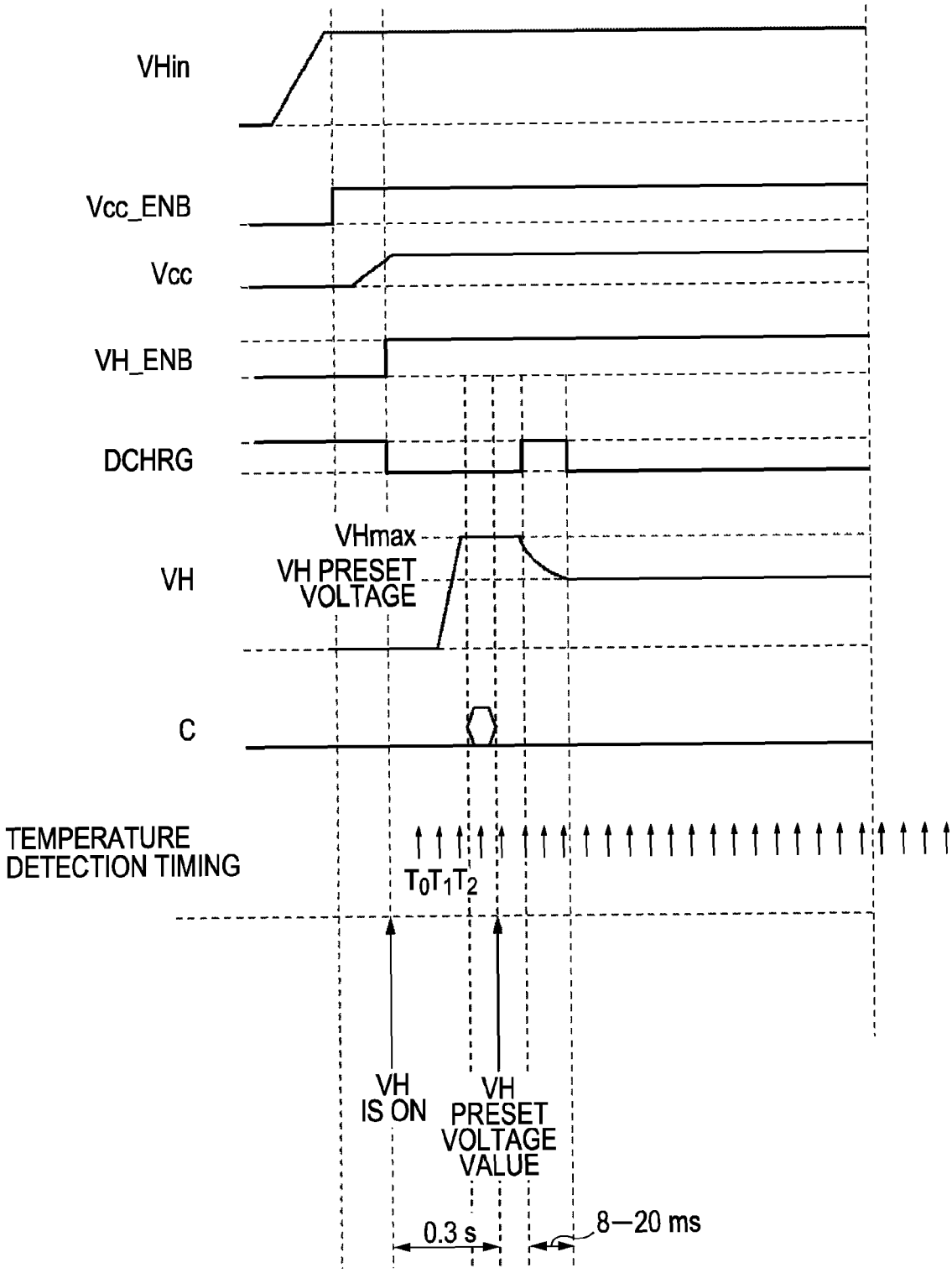
FIG. 11 is a diagram of a timing of activation of the DC/DC converter.
Figure 12A:
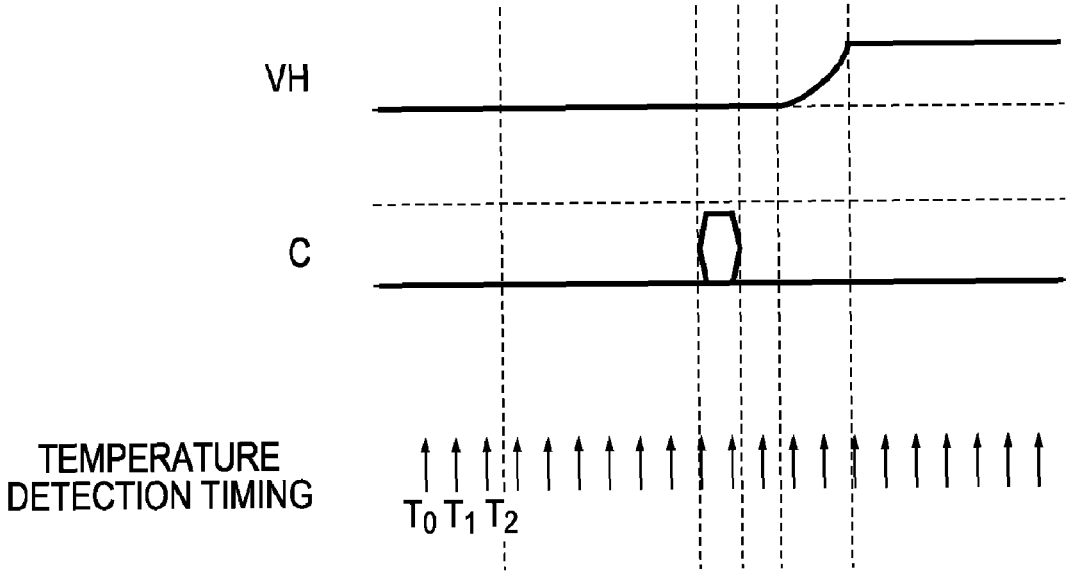
FIGS. 12A and 12B are diagrams of a timing of VH modulation during a recording operation.
Figure 12B:
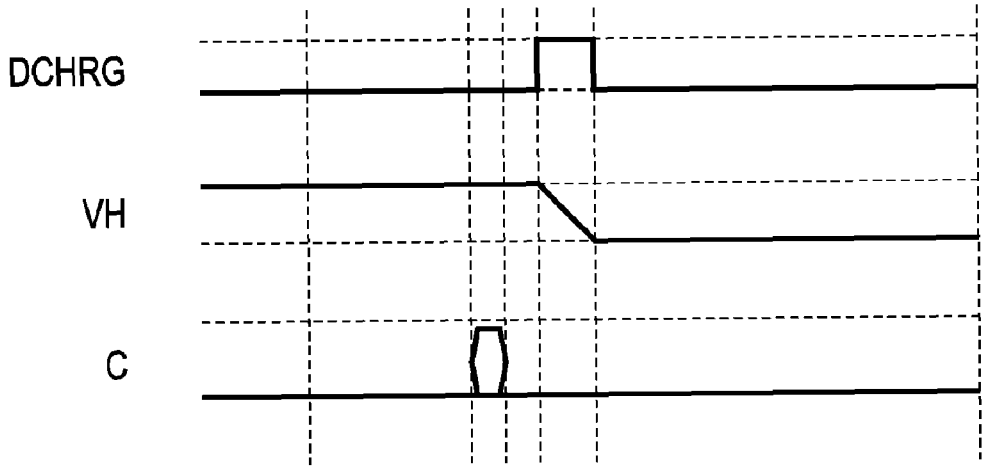

FIG. 11 is a diagram that enlarges a timing of a VH activation illustrated in FIG. 5 in terms of time. FIGS. 12A and 12B are diagrams each enlarging a timing of VH modulation operation in a section of a2 in FIG. 5 in terms of time. In the a2 section, as illustrated in FIG. 12A, the voltage VH is enhanced. When the temperature of the recording head 2 rises, the amount of ink ejection increases. In the a2 section, the voltage VH is enhanced in order to suppress the increase in the amount of ink ejection.

On the other hand, for example, if the temperature of the recording head 2 declines, the amount of ink ejection decreases. In the a2 section, in order to suppress the reduction in the amount of ink ejection, the voltage VH is reduced. FIG. 12B illustrates the processing for reducing the voltage VH.

In FIG. 12A, for example, after the temperature is detected at $T_0$, $T_1$, and $T_2$, on the basis of the results of the temperature detection, a control signal C that indicates a target voltage is output. Therefore, the voltage VH can be increased to a desired voltage.

In FIG. 12B, on the basis of the results of the temperature detection, a control signal C that indicates a target voltage is output, and, additionally, an indication signal DCHRG for discharge is output. Therefore, the voltage VH can be reduced to a desired voltage. In FIG. 12B, although a timing of temperature detection is omitted, the temperature detection is performed, as in the case of FIG. 12A.

A section of (c) in FIG. 5 represents that the printer is in a print standby mode (prior to a soft power on) or the power source is in an off state. In this section, an output VH of the DC/DC converter 50 is 0 volt by the L level of the Vcc_ENB signal and the VH_ENB signal and the H level of the DCHRG signal.

The temperature of the recording head 2 is measured by a temperature sensor, such as a diode sensor, in units of, for example, 10 ms. The diode sensor is disposed on a heater board (base member) on which the heaters are mounted. It is difficult for a temperature sensor, such as the diode sensor, to accurately measure the temperature while the heaters of the recording head 2 are being driven because of superimposition of noise caused by effects of a driving signal.

More specifically, the temperature is measured as a value that is approximately 20° C. higher than a value that would be detected when the heaters are not driven because of superimposition of a noise component caused by a driving signal. It has been found that, since the temperature of the recording head during printing rises on the order of a few seconds to several tens of seconds or declines on the order of several tens of seconds to a few minutes, the temperature of the recording head 2 detected on the order of milliseconds does not vary significantly.

As a result, the difference in temperature data between a head-temperature datum detected at a timing and a head-temperature datum detected at a next timing is managed by a digital filter disposed in the ASIC. If a sharp change in temperature is detected in a short period of time, the detected temperature data is cancelled as data on which a noise component is superimposed. Alternatively, the data is processed as data that has no temperature change (e.g., 1° C. or less).

When, at a timing of (d) in FIG. 5, the soft power on is activated or the power is switched on, the Vcc_ENB signal and the VH_ENB signal shift from the L level to the H level and the DCHRG signal shifts from the H level to the L level. Therefore, the control IC of the DC/DC converter 50 is activated, the discharge circuit, which has caused the output voltage to be 0 V, is brought in an off operation, and the DC/DC converter 50 is activated. At this time, data is not output to the D/A converter 211, and thus the output of the DC/DC converter 50 rises to a predetermined voltage value (VHmax) during the activation. When the soft power on is activated or the power is switched on, then the temperature of the recording head is detected in units of, for example, 10 ms.

The ASIC 31 acquires a base temperature $T_0$ of the recording head within 0.3 seconds after the activation of the DC/DC converter 50 and then refers to a table (not shown) of the recording head 2 temperature to the set voltage. The ASIC 31 transmits a voltage control signal C to the D/A converter 211. The D/A converter 211 outputs an output voltage $V_A$ according to the value of the voltage control signal C. The switching element Q102 in the discharge circuit 301 is turned on in response to the DCHRG signal transmitted from a controller for a fixed period of time after the ASIC 31 transmits the voltage control signal C. At this time, a charge flows as a discharge current from the capacitor C101 via the resistor R6.

If the value of the voltage VH decreases from VHmax to VHx, a period of time during which the discharge circuit 301 is in the on state is represented by the following expression:

$$\text{ton} = -R6 \times C101 \times \ln\frac{VHx}{VH\max}$$

where C101 represents an output capacitance of the capacitor C101 in the DC/DC converter 50 and R6 represents a resistance of the resistor R6. In FIG. 5, the period of time during which the discharge circuit 301 is in the on state is in a range of 8 ms to 29 ms.

This processing causes the voltage of the capacitor C101 (VH voltage) to decrease to a second voltage value (preset voltage value) determined from the base temperature $T_0$ of the recording head 2.

In the present embodiment, the amount of electric energy applied on the capacitor C101 by the voltage setting signal C is larger than the amount of electric energy discharged by the discharge circuit 301. Therefore, discharge processing of the discharge circuit 301 is always performed at a timing set by the voltage setting signal C, so that the output voltage VH is increased or reduced.

As described above, the VH voltage has a set value set by a set voltage of the D/A converter 211. The output voltage VH in a short period of time is adjusted by a combination of feedback control in the power-source circuit (DC/DC converter 50) and discharge processing.

Another method for adjusting the level of the output voltage VH is to operate the discharge circuit 301 at a timing set by the voltage control signal C only when the output voltage VH is to be reduced.

Processing of ejecting ink from the recording head 2 includes preliminary ejection (processing) for ejecting ink on a regular basis to prevent the nozzle from clogging and main ejection (processing) for ejecting ink to form an image.

The main ejection is performed when the carriage 3 is positioned directly above the recording medium, whereas the preliminary ejection is performed when the carriage 3 is not positioned directly above the recording medium but is at its home position.

The temperature of the recording head 2 gradually rises when recording operation continues. In the sections A and B illustrated in FIGS. 4 and 5, since only the preliminary ejection is performed, a rise in the temperature is mild.

Data detected by the temperature sensor during the main ejection, in which ink is ejected onto the recording medium, contains a superimposed noise component. Therefore, temperature information of the recording head 2 is cancelled by a digital filter or some other member.

Temperature data (information on temperature) is acquired in a fixed period of time (0.2 s) in the ranges A and B, where the reciprocating motion is turned from the forward direction (forward scan) to the return direction (return scan), outside the printing area, the ranges A and B being an acceleration/deceleration range of the carriage.

The temperature data is digitized by the A/D converter (not shown) in order to be processed by the ASIC 31 on the main substrate 30. By use of the digitized information, information on the set voltage of the DC/DC converter 50 held in the ROM 32 is referred to. The information on the set voltage read from the ROM 32 is output from the ASIC 31 toward the DC/DC converter 50.

In the information on the set voltage held in the ROM 32, information on the nozzle rank is a parameter. Therefore, even if there are variations in the ejection characteristics of the nozzles of the recording head 2, accurate correction can be performed.

The voltage VH of the DC/DC converter 50 is controlled in such a way that the voltage VH is modulated when the temperature of the recording head 2 changes by a predetermined fixed value of ±ΔT° C. (e.g., 5° C.) or more relative to the base temperature $T_0$. If the temperature does not change by ±ΔT or more relative to the base temperature $T_0$, the VH modulation operation is not performed, and the DC/DC converter 50 is driven with the unmodulated VH voltage.

In an example illustrated in FIG. 5, when print data is sent to the recording head 2 and printing starts, the temperature of the recording head 1 gradually rises. At a timing of temperature detection of $T_{n-1}$, a rise in the temperature is predetermined +ΔT° C. (5° C. in an example illustrated in FIG. 4) relative to the base temperature $T_0$. After a timing of temperature detection of the recording head 2 of $T_{n-1}$, predetermined-VH-voltage mapping information for the temperature of the recording head 2 to the set voltage of the DC/DC converter 50 is referred to, the voltage control signal C is transmitted to the D/A converter 211, and then the DCHRG signal is transmitted to the discharge circuit 301.

By this series of operations, after a temperature detection timing of $T_{n-1}$, a section a2 in FIG. 5, which is an interval between an operation in the return direction and that in the forward direction, the VH modulation control is performed. In FIG. 5, a period of time during which the voltage VH is modulated is in a range of 2 ms to 10 ms. This period of time is determined from the time required for response to a feedback loop of the DC/DC converter 50 in the case in which the voltage VH rises from VHx1 to VHx. In an example illustrated in FIG. 5, a width of voltage modulation from VHx1 to VHx is 1.5 V, and the modulation is performed within 2 ms.

In the case in which, at a timing of $T_{n-1}$ the temperature changes by predetermined ±ΔT° C. or more relative to the base temperature $T_0$ and the voltage VH is modulated, the base temperature information stored in the controller is rewritten to temperature information at $T_{n-1}$ as new base information, and the next VH modulation is performed for a temperature change of ±ΔT or more relative to the temperature at $T_{n-1}$.

In FIG. 5, in the standby state after a status of being ready to record (e.g., 1 minute), while preliminary ejection is performed at fixed time intervals (e.g., 2 second intervals), the recording head 2 awaits the start of printing at its home position. Since only the preliminary ejection from the recording head 2 is performed in the standby state, although a change is small, the temperature of the recording head 2 gradually decreases.

In FIG. 5, the temperature detected at a timing of $T_{m-1}$ changes by −ΔT relative to that at $T_{n-1}$, at which the previous VH modulation was performed. Therefore, at a temperature detection timing of $T_{m-1}$, the VH modulation control is performed.

Since the temperature of the recording head 2 at a temperature detection timing of $T_{m-1}$ changes by −ΔT° C. relative to the base temperature at $T_{n-1}$, after a temperature detection timing of $T_{m-1}$, predetermined-VH-voltage mapping information for the temperature of the recording head to the set voltage of the DC/DC converter 50 is referred to, the voltage control signal C is transmitted to the D/A converter 211, and then the DCHRG signal is transmitted to the discharge circuit 301.

By this series of operations, after a temperature detection timing of $T_{m-1}$ in FIG. 5, in an interval between preliminary ejections, the VH modulation control is performed.

If the value of the voltage VH decreases from VHx to VHx1, a period of time during which the voltage is modulated after $T_{m-1}$ is represented by the following expression:

$$\text{ton} = -R6 \times C101 \times \ln\frac{VHx1}{VHx}$$

where C101 represents an output capacitance of the capacitor C101 in the DC/DC converter 50 and R6 represents a resistance of the resistor R6. In FIG. 5, a width of voltage modulation from VHx to VHx1 is −1.5 V, and the modulation is performed within a range of 2 ms to 10 ms.

In the present embodiment, the modulation of the voltage VH is completed before the recording head 2 starts a printing operation both for modulation of increasing voltage VH and modulation of reducing the voltage VH. This is because, if printing starts before the completion of the VH modulation operation, the amount of ink ejection would vary, and the image quality would be degraded. As a result, a period of time during which the discharge circuit 301 performs discharge for a width of voltage modulation (control width) is shorter than a pause period of recording (pause timing), which is an interval between a scan and a next scan.

In FIG. 5, if print data has not been received from the host device 51 for a fixed period of time (e.g., 2 minutes), a capping operation is performed as an operation of the recording apparatus, the VH_ENB signal changes from the H level to the L level, the DCHRG signal changes from the L level to the H level, and the DC/DC converter 50 stops operating. As a result, the VH voltage has a value of 0 V.

In FIG. 5, the DC/DC converter 50 is activated without transmission of data of the D/A converter 211. After that, the temperature of the recording head 2 $T_0$ is referred to, the DC/DC converter 50 is controlled with a voltage value corresponding to the referred temperature. However, these operations may be reversed. That is, the temperature of the recording head 2 $T_0$ may be read before the activation of the DC/DC converter 50, and data corresponding to the temperature is output to the D/A converter 211 at the activation.

Figure 6:
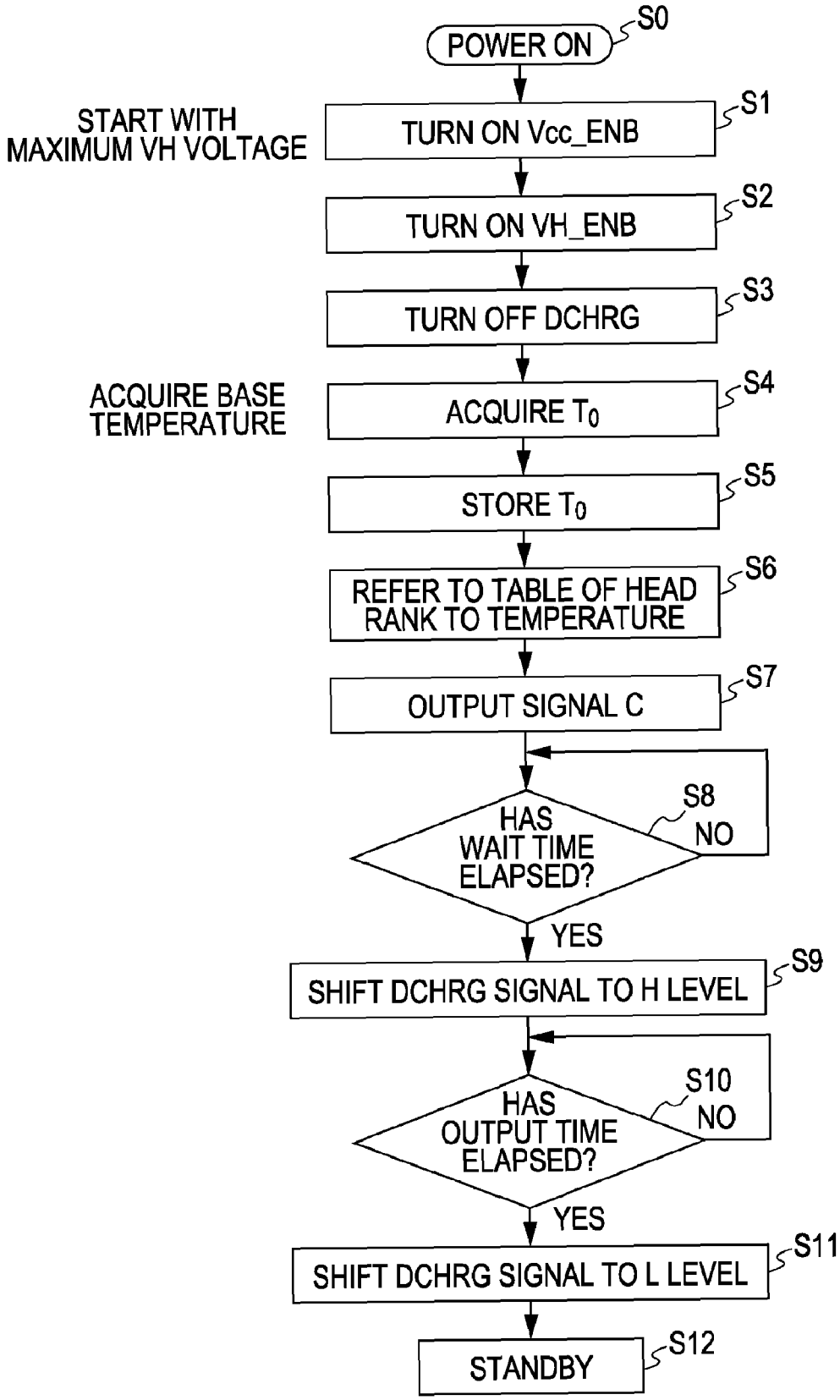
FIG. 6 is a flowchart for describing a timing of temperature detection and a timing of modulation of an output voltage of the DC/DC converter according to the exemplary embodiment.

FIG. 6 is a flowchart for describing a timing of temperature detection and a timing of VH modulation control at the activation.

FIG. 11 is a diagram that enlarges a timing of an activation illustrated in FIG. 5. FIG. 11 also illustrates waveforms of VHin, Vcc_ENB, and Vcc signals.

Turning to FIG. 6, in step S0, the power of the recording apparatus is turned on (or soft power on is activated). Then, in step S1, the Vcc_ENB signal is turned on, thereby shifting the Vcc voltage to be supplied to the D/A converter 211 to the H level.

In step S2, the VH_ENB signal of the DC/DC converter 50 is shifted to the H level. Then, in step S3, the DCHRG signal is shifted to the L level. Therefore, the level of the voltage VH of the DC/DC converter 50 is shifted to VHmax (first voltage).

In step S4, the base temperature $T_0$ of the recording head 2 is acquired. Next, in step S5, the base temperature $T_0$ is stored in the RAM. In step S6, a table of the head rank and the temperature is referred to. In step S7, the referred voltage set value is transmitted to the D/A converter 211 in the form of a digital signal.

Figure 7:
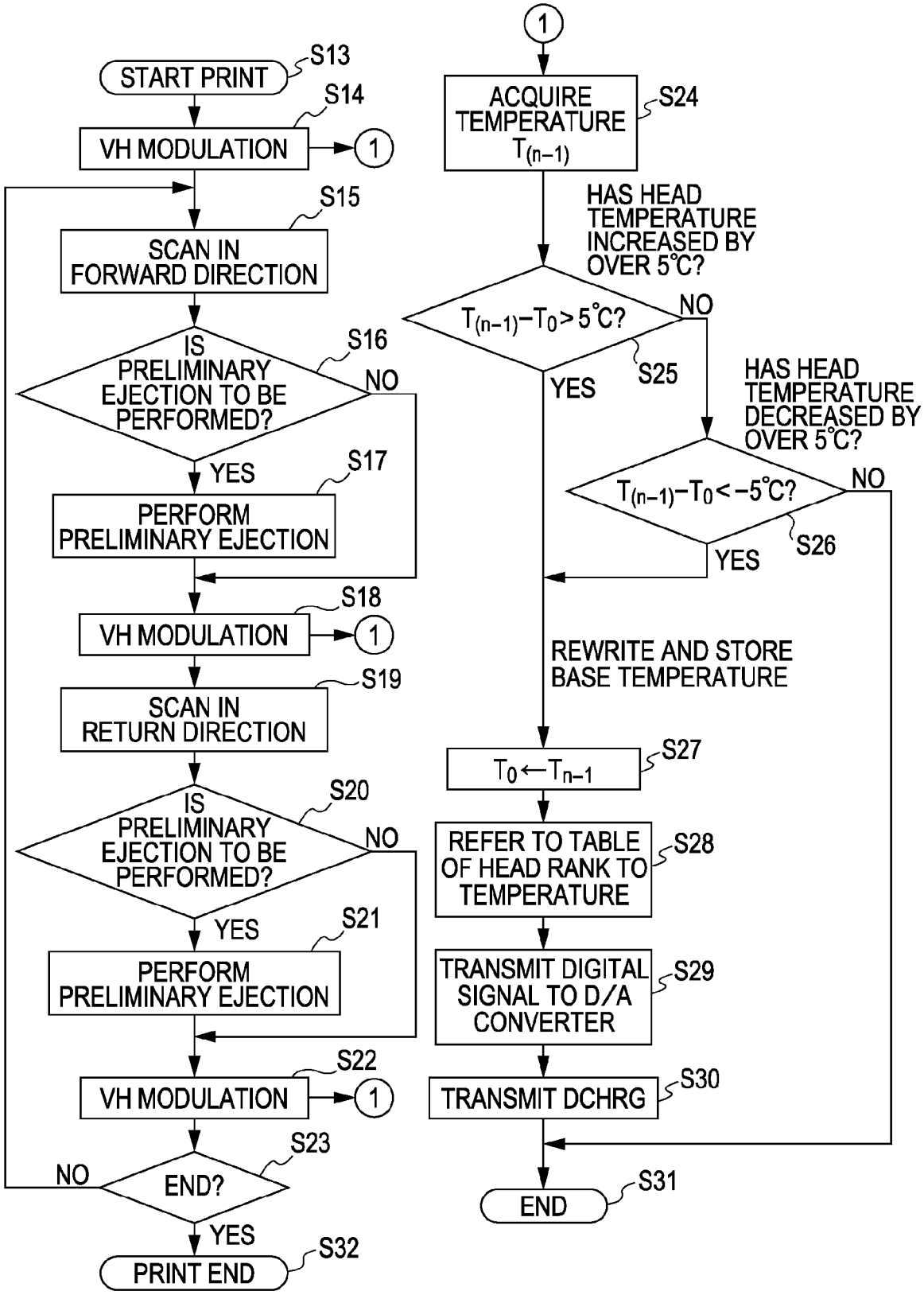
FIG. 7 is another flowchart for describing a timing of temperature detection and a timing of modulation of an output voltage of the DC/DC converter according to the exemplary embodiment.

Flow proceeds to step S8, where a predetermined time period is waited, so that the output of the D/A converter 211 is changed by this waiting. When the predetermined time period has been exceeded, in step S9, the DCHRG signal is shifted to the H level, thereby causing the discharge circuit to operate. Next, in step S10, if it is determined that the DCHRG signal has been output for more than a fixed time period, the DCHRG signal is shifted to the L level in step S11, thereby stopping conduction of the discharge circuit. Then, in step S12, the VH voltage changes to a preset voltage (second voltage), and the printer is in a standby state. FIG. 7 is a flowchart for describing a timing of temperature detection and a timing of VH modulation control during printing. First, printing starts (step S13). Then, as a sequence of VH modulation (step S14), the temperature of the recording head 2 is acquired by the ASIC at fixed intervals (step 24). In steps S25 and S26, the acquired temperature is compared with the base temperature $T_0$. Here, temperature data acquired during printing is processed as data that has no temperature change or is canceled by a digital filter because a noise component is superimposed thereon and the detected temperature is higher than the actual temperature. After scanning in the forward direction in step S15, flow proceeds to step S16, where it is determined whether preliminary ejection is to be performed. If, in step S16, it is determined that preliminary ejection is to be performed (YES), flow proceeds to step S17, where the preliminary ejection is performed. If, in step S16, it is determined that preliminary ejection is not to be performed (NO), flow proceeds to step S18. After scanning in the return direction in step S19, flow proceeds to step S20, where it is determined whether preliminary ejection is to be performed. If, in step S20, it is determined that preliminary ejection is to be performed (YES), flow proceeds to step S21, where the preliminary ejection is performed. If, in step S20, it is determined that preliminary ejection is not to be performed (NO), flow proceeds to step S22.

Therefore, in an interval between a scan in the forward direction (step S15) and a scan in the return direction (step S19), at which the recording head does not perform a print operation, or in an interval between a scan in the return direction and a scan in the forward direction, the temperature of the recording head 2 is reflected and the VH modulation control is performed. That is, the VH modulation control is performed in a period of time (timing) corresponding to an acceleration/deceleration range and a stop range, at which printing performed by the reciprocating motion of the recording head 2 is not performed.

The execution of the VH modulation control is determined by whether the difference between the temperature of the recording head 2 acquired in step S24 and the base temperature $T_0$ is equal to or larger than a predetermined value. In FIG. 7, a change of 5° C. relative to the base temperature $T_0$ is detected (steps S25 and S26). If a change is 5° C. or more (YES in step S25), the base temperature is updated from $T_0$ to $T_{n-1}$ (step S27). If a change is −5° C. or more (YES in step S26), the base temperature is updated from $T_0$ to $T_{n-1}$ (step S27). In other words, when $-5° C. < T_{n-1} - T_0 < 5° C.$, processing of steps S27 through S30 is omitted. The table of the head rank to the temperature is referred to for the updated temperature (step S28). Then, a digital signal is transmitted to the D/A converter (step S29). The DCHRG signal is transmitted (step S30). After that, flow proceeds to step S31, where the processing is completed. The VH modulation operation is thus performed. In step S23, it is determined whether the recording operation is to be completed. If, in step S23, it is determined that the recording operation is not to be completed (NO), flow returns to step S15. If, in step S23, it is determined that the recording operation is to be completed (YES), flow proceeds to step S32. In the present embodiment, the DCHRG signal is output without exception. However, the DCHRG signal may be output only when the recording-head driving voltage VH is caused to be reduced.

By this series of operations, using temperature information detected at a timing at which the recording head 2 does not eject ink, the recording-head driving voltage VH is also modulated at a timing at which the recording head 2 does not eject ink.

The temperature data is processed by the digital filter in the ASIC. Additionally, the VH modulation control can be performed more precisely by use of information from the carriage encoder 403, which detects the position of the recording head 2. The more precise VH modulation control in an acceleration range, a deceleration range, and a stop range in the reciprocating motion of the head carriage unit is described below with reference to FIGS. 8A to 8E.

In sections A or B illustrated in FIG. 5, preliminary ejection may or may not be performed. A timing of the preliminary ejection and a timing of the VH modulation control can be varied depending on printing conditions (conditions for printing operation or recording mode).

FIGS. 8A to 8E are schematic diagrams illustrating the preliminary ejection and the VH modulation operation in acceleration and deceleration ranges and a stop range during a printing operation of the head carriage unit. More specifically, in FIGS. 8A to 8E, time progresses from left to right. In other words, after the recording head performs a previous scan, the recording head stops. Subsequently, the recording head performs a next scan.

FIG. 8A shows a case in which preliminary ejection is not performed in an acceleration range, a deceleration range, and a stop range of the head carriage unit. In the acceleration range, the deceleration range, or the stop range, the temperature of the recording head 2 is acquired and the VH modulation control is performed. In this drawing, the VH modulation control is performed in the stop range. However, the VH modulation control may be performed in the acceleration range or the deceleration range. If the VH modulation control is performed in an acceleration range, which is immediately before the next main ejection, newer temperature information of the recording head 2 can be reflected, and thus recording with a more accurate amount of ink ejection can be realized.

FIGS. 8B to 8E illustrate cases in which the preliminary ejection is performed in a stop range of the recording head 2 (head carriage unit). FIG. 8B illustrates a sequence (control) in which the VH modulation control is performed after the preliminary ejection. The temperature of the recording head 2 acquired after the preliminary ejection is reflected on the VH modulation control. If the nozzles of the recording head 2 are less prone to being clogged, the VH modulation control is performed before recording on a priority basis.

FIG. 8C illustrates a sequence (control) in which the VH modulation control is performed before the preliminary ejection. In other words, FIG. 8C illustrates a sequence (control) in which the preliminary ejection is performed after the VH modulation control. Before a timing of the preliminary ejection, a VH voltage value on which the temperature of the recording head 2 has been reflected is modulated. This process can reliably avoid clogging of the nozzles of the recording head 2 before printing. In other words, the amount of energy required for the preliminary ejection can be adjusted by adjustment of the VH voltage.

In the case of FIG. 8B, the energy of the preliminary ejection may be adjusted by control of a pulse width. In the case of FIG. 8C, the pulse width control can be omitted from the ASIC of the controller. Therefore, a load imposed on the controller can be reduced.

FIG. 8D illustrates a case in which a timing of the preliminary ejection overlaps a timing of the VH modulation control. In this case, the preliminary ejection and the VH modulation control are simultaneously performed. As in the case of FIG. 8C, the temperature information of the recording head 2 can be acquired before the preliminary ejection, so the accurate VH modulation control can be performed.

Since the operation of the discharge circuit and the preliminary ejection overlap one another, power consumed by the preliminary ejection processing is employed as a discharge current of output of the DC/DC converter 50. As a result, the time required for the VH modulation can be reduced.

FIG. 8E illustrates a modification of FIG. 8D and illustrates a case in which the preliminary ejection overlaps the latter half of the VH modulation control. That is, after the discharge circuit starts operating in the VH modulation control, the preliminary ejection starts.

VH modulation control that uses position information from the carriage encoder 403 can perform modulation every one scan of the head carriage unit, not for a change of a predetermined fixed value of $\pm\Delta T^{\circ}$ C. In this case, more precise VH modulation control can be realized.

Processing occurring when the recording head 2 does not move has been described with reference to FIGS. 8A to 8E. However, the present invention is not limited to these examples. For example, in FIG. 8A, even in a deceleration range, the temperature of the recording head 2 may be acquired and the voltage modulation processing may be performed as long as the recording head 2 finishes ink ejection. Alternatively, for example, even in an acceleration range, the temperature of the recording head 2 may be acquired and the voltage modulation processing may be performed as long as a period of time during which the recording head 2 does not start ink ejection is maintained.

Alternatively, in FIG. 8B, even in a deceleration range, the preliminary ejection to a preliminary ejection area may be performed, and, thereafter, the temperature of the recording head 2 may be acquired and the voltage modulation processing may be performed as long as the recording head 2 finishes ink ejection. Alternatively, for example, even in an acceleration range, the temperature of the recording head 2 may be acquired and the voltage modulation processing may be performed as long as a period of time during which the recording head 2 does not start ink ejection is maintained.

Alternatively, in FIG. 8C, even in a deceleration range, the temperature of the recording head 2 may be acquired, and, thereafter, the voltage modulation processing and the preliminary ejection to a preliminary ejection area may be performed as long as the recording head 2 finishes ink ejection. Alternatively, for example, even in an acceleration range, the temperature of the recording head 2 may be acquired and the voltage modulation processing may be performed as long as a period of time during which the recording head 2 does not start ink ejection is maintained. A parameter for time is not limited to the above-described values.

As described above, even when the temperature of the recording head 2 varies, the voltage for driving the recording head 2 can be adjusted at a timing at which the recording head 2 does not perform a printing operation. Therefore, the amount of ink ejected from the recording head 2 can be stabilized and image recording with high image quality can be realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A recording apparatus for performing recording by scanning a recording head, the recording apparatus comprising:

an acquisition unit configured to acquire temperature information of the recording head;

a generation unit configured to generate a signal that indicates outputting of an output voltage based on the temperature information;

a voltage control unit configured to control a voltage to be output to the recording head based on the signal; and a control unit configured to simultaneously perform preliminary ejection processing in an interval between a previous scan and a next scan of the recording head and output processing of the signal, wherein the voltage control unit is a DC-to-DC converter, the DC-to-DC converter including a discharge circuit configured to perform discharge processing based on a signal, output from the control unit, indicating discharge, and wherein a time constant for discharge of the discharge circuit is a value that enables discharge of a controllable voltage width in a period of time shorter than a stop interval of the recording head between a previous scan and a next scan.

2. The recording apparatus according to claim 1, wherein the acquisition unit acquires the temperature information while the recording head is not ejecting ink.

* * * * *